US007751943B2

(12) United States Patent
Bollhalder et al.

(10) Patent No.: US 7,751,943 B2
(45) Date of Patent: Jul. 6, 2010

(54) PROTECTION PROCESS AND CONTROL SYSTEM FOR A GAS TURBINE

(75) Inventors: Heinz Bollhalder, Doettingen (CH); Michael Habermann, Waldshut-Tiengen (DE); Hanspeter Zinn, Ruetihof (CH)

(73) Assignee: ALSTOM Technology Ltd., Baden (CH)

( * ) Notice: Subject to any disclaimer, the term of this patent is extended or adjusted under 35 U.S.C. 154(b) by 1102 days.

(21) Appl. No.: 11/275,858

(22) Filed: Feb. 1, 2006

(65) Prior Publication Data

US 2006/0266045 A1 Nov. 30, 2006

(30) Foreign Application Priority Data

Feb. 3, 2005 (CH) ..... 0161/05

(51) Int. Cl.

| | |
|---|---|
| ***G05D 3/12*** | (2006.01) |
| ***G05D 5/00*** | (2006.01) |
| ***G05D 9/00*** | (2006.01) |
| ***G05D 11/00*** | (2006.01) |
| ***G05D 17/00*** | (2006.01) |
| *F02C 3/00* | (2006.01) |
| *F02C 9/00* | (2006.01) |
| *F02C 7/36* | (2006.01) |
| *F02G 3/00* | (2006.01) |
| *G05D 13/00* | (2006.01) |

(52) U.S. Cl. ..... 700/292; 700/287; 700/290; 700/304; 60/39.01; 60/39.24; 60/775; 477/30; 701/100

(58) Field of Classification Search ..... 700/287, 700/290, 292, 304; 60/39.01, 39.27, 775; 477/30; 701/100

See application file for complete search history.

(56) References Cited

U.S. PATENT DOCUMENTS

| | | | | |
|---|---|---|---|---|
| 5,544,478 | A | 8/1996 | Shu et al. | |
| 6,095,793 | A * | 8/2000 | Greeb | 431/12 |
| 6,535,124 | B1 | 3/2003 | DiTommaso et al. | |

(Continued)

FOREIGN PATENT DOCUMENTS

| | | |
|---|---|---|
| DE | 19941917 | 6/2000 |

(Continued)

OTHER PUBLICATIONS

Search Report for Swiss Patent App. No. CH 1612005 (May 20, 2005).

(Continued)

*Primary Examiner*—Ramesh B Patel
(74) *Attorney, Agent, or Firm*—Cermak Nakajima LLP; Adam J. Cermak

(57) ABSTRACT

In a process for protection of a gas turbine (1) from damage caused by pressure pulsations (P), pressure pulsations (P) occurring during the operation of the gas turbine (1) are measured, from the measured pressure pulsations (P), a pulsation-time signal (PZS) is generated, the pulsation-time signal (PZS) is transformed into a pulsation-frequency signal (PFS), from the pulsation-frequency signal (PFS), a pulsation level (PL) is determined for at least one specified monitoring frequency band (12), the pulsation level (PL) is monitored for the occurrence of at least one specified trigger condition, and, when the at least one trigger condition occurs, a specified protective action (16) is carried out.

15 Claims, 3 Drawing Sheets

U.S. PATENT DOCUMENTS

| | | | | |
|---|---|---|---|---|
| 6,591,182 | B1 * | 7/2003 | Cece et al. | 701/100 |
| 6,839,613 | B2 * | 1/2005 | McCarthy et al. | 700/287 |
| 2003/0211432 | A1 | 11/2003 | Gutmark et al. | |
| 2004/0011020 | A1 * | 1/2004 | Nomura et al. | 60/39.281 |
| 2004/0148940 | A1 * | 8/2004 | Venkateswaran et al. | 60/772 |
| 2004/0177694 | A1 * | 9/2004 | Harrold et al. | 73/702 |
| 2004/0193355 | A1 * | 9/2004 | Faymon et al. | 701/100 |
| 2004/0194468 | A1 * | 10/2004 | Ryan et al. | 60/773 |
| 2006/0112697 | A1 * | 6/2006 | Rowe | 60/772 |
| 2006/0241886 | A1 * | 10/2006 | Ponziani | 702/113 |
| 2006/0263216 | A1 * | 11/2006 | Brummel | 416/61 |
| 2006/0283190 | A1 * | 12/2006 | Thomassin et al. | 60/772 |
| 2008/0218758 | A1 * | 9/2008 | Xia et al. | 356/437 |

FOREIGN PATENT DOCUMENTS

| | | |
|---|---|---|
| EP | 1286031 | 2/2003 |
| EP | 1327824 | 7/2003 |
| WO | WO2004/010052 | 1/2004 |
| WO | WO2004/092650 | 10/2004 |

OTHER PUBLICATIONS

Search Report for European Patent App. No. 06101128 (May 19, 2006).

* cited by examiner

PROTECTION PROCESS AND CONTROL SYSTEM FOR A GAS TURBINE

This application claims priority under 35 U.S.C. §119 to Swiss application number 00161/05, filed 3 Feb. 2005, the entirety of which is incorporated by reference herein.

BACKGROUND OF THE INVENTION

1. Field of the Invention

The present invention is concerned with a process for protection of a gas turbine from damage caused by pressure pulsations. The invention is additionally concerned with a control system for carrying out a protection process of this type.

2. Brief Description of the Related Art

During the operation of a gas turbine, pressure pulsations can occur, especially in a combustion chamber of the gas turbine, due to the combustion process. Phenomena of this type can occur in frequency ranges of 2 Hz to several kHz, and they are accordingly also referred to as humming, screeching, or in more general terms, flame instabilities. These pulsations, if they have high amplitudes or if they last too long, can cause serious damage to the structure or to individual components of the gas turbine, especially to its combustion chamber, thus shortening the life of the gas turbine. Furthermore, pulsations may signal malfunctions in the combustion reaction, which may be caused, for example, by fluctuations in the fuel and/or fresh-air supply or by abrupt load changes. In isolated cases the pulsations can also extinguish the combustion reaction or its flame, which will cause an explosive gas mixture to form.

Modern gas turbines are therefore equipped with a pulsation protection system, which, on one hand, detects the pressure pulsations that occur during the operation of the gas turbine, and which, on the other hand, triggers appropriate protective actions, such as shutting down the gas turbine, when specified trigger conditions occur, such as a sudden occurrence of pulsations with very high amplitudes, or the occurrence of medium-amplitude pulsations for an extended length of time. Measuring of the pressure pulsations may take place, for example, with the aid of an appropriate pressure sensor, with the aid of which a pulsation-time signal can be generated that correlates with the occurring pulsations. A "pulsation-time signal" in the present context is understood to mean a signal that represents the amplitudes of the pulsations (ordinate values) in dependence on the time (abscissa values). The pulsation-time signal that is determined in this manner can now be split using electronic or digital methods according to Tchebychev, or the like, into certain monitoring frequency bands, which can be analyzed and evaluated individually. In the process it may be practical to perform an averaging process within the respective monitoring frequency band.

A process of this type for protection of the gas turbine from damage caused by pressure pulsations, however, is relatively inaccurate in its operation. For safety reasons it is therefore possible that protective actions, for example an emergency shutdown of the gas turbine, may occur even though this may not yet actually be necessary. An unnecessarily caused shutdown of the gas turbine, however, involves high costs and losses of income.

SUMMARY OF THE INVENTION

This is where the invention wants to provide a remedy. An aspect of the present invention deals with presenting an improved process for protection of a gas turbine from damage caused by pressure pulsations, which especially exhibits a comparatively high degree of reliability and prevents unnecessary protective actions whenever possible.

Another aspect of the present invention includes the general idea of monitoring the pressure pulsations with the aid of a pulsation-frequency signal. Yet another aspect includes that the band frequencies are maintained very precisely and the signal permeability within the band, or signal blocking outside the band is ideal as desired in accordance with the utilized system performance (for example computer performance). A "pulsation-frequency signal" in the present context is intended to mean a signal that represents the amplitudes of the pulsations (ordinate values) in dependence on the frequency (abscissa values). From a pulsation-frequency signal of this type it is particularly easy to obtain specified monitoring frequency bands. Additionally, the frequency bands can be selected ideally narrow in accordance with the utilized system performance (computer performance), permitting a targeted and separate monitoring of certain pulsation frequencies without distorting their amplitudes. Yet another aspect of the present invention, in this context, is also based on the realization that interfering or critical, i.e., dangerous pulsation frequencies may lie relatively close to harmless pulsation frequencies, so that a comparatively broad monitoring frequency band, due to the nature of the system, also detects harmless pulsation frequencies and accordingly cannot distinguish them from the critical pulsation frequencies, and a distortion, especially a swelling, of the amplitudes of certain pulsation frequencies occurs as well. The width of the monitoring frequency bands in the case of a pulsation-time signal by means of conventional bandpass filters (Tchebychev or the like) cannot be selected arbitrarily small. Due to the technical characteristics of these band filters, the effect of this is more pronounced, the greater the frequencies that need to be filtered out. Since the critical pulsation frequencies, depending on the type of gas turbine, are especially greater than 1 kHz, the monitoring frequency bands selectable in the case of a pulsation-time signal are always relatively wide. The monitoring frequency bands in the case of the pulsation-frequency signal, in contrast, can be selected ideally narrow in accordance with the utilized system performance, so that it is especially possible to exclude closely adjacent harmless pulsation frequencies from the pulsation monitoring process. Additionally, in a preferred embodiment, a dynamic adaptation of the system parameters (especially bandpass limits, time constants, etc.) may be performed to various operating conditions of the gas turbine, for example normal operation, startup, unloading, fuel change, etc.

In a preferred exemplary embodiment a pulsation level, which is monitored within the respective monitoring frequency band, may be formed by the maximum pulsation value in the respective monitoring frequency band. This means that, within the respective monitoring frequency band, the pulsation maximum (peak) is monitored in each case. In contrast to an alternatively possible summation or integration, or generally an averaging process, monitoring of the pulsation maximum ensures that, with a high degree of probability, only the level of the actually dangerous or critical pulsation frequency is monitored, thus improving the reliability of the monitoring process.

According to a particularly advantageous improvement, the monitoring frequency band can be shifted, with the aid of a suitable algorithm, to follow the maximum pulsation value in case of a frequency shift of the maximum pulsation value, namely in such a way that the maximum pulsation level always remains within the monitoring frequency band. In this embodiment it is taken into account that the critical pulsation frequency that is assigned to the respective monitoring frequency band may change. The measured pulsation frequency depends, for example, on the sound velocity at the point of origin of the pulsations, said sound velocity, in turn, being temperature-dependent. During the operation of the gas turbine the temperature can change especially in its combustion chamber, resulting in a corresponding change in the sound velocity and, therefore, in a shifting of the critical pulsation frequencies. Other parameters that influence the pulsation frequency are, for example, the composition of the gas. It can change, for example, as a result of a different fuel being used and/or a different fuel-air mixture (λ value) and/or a different fuel-water mixture (Ω value) being selected. Due to the automatic adaptive shifting of the monitoring frequency band, the critical pulsation frequency being monitored cannot migrate out of the monitoring frequency band. This has the result that, with the aid of the invention, needlessly triggered protective actions, control errors, or misinterpretations of the pressure pulsations that are due to the above changes no longer occur.

In an advantageous improvement, the inventive signal processing method can be used for machine protection in accordance with a trigger strategy. This trigger strategy may be characterized in that it operates with a trigger counter and with a reset counter, in such a way that the trigger counter adds the time during which the respective pulsation level lies above a specified level limit value to the given preceding count of the counter. The trigger condition arises and the specified protective action is started if the trigger counter reaches a specified trigger counter reading. The reset counter, in contrast, adds the time during which the respective pulsation level does not lie above the above-mentioned level limit value to a count that has been set to zero in each case. Furthermore, the count of the trigger counter is always set to zero when the reset counter reaches a specified reset counter reading. On one hand, due to the inventive trigger strategy, critical pulsation frequencies whose amplitude remains above the specified level limit value for an extended period of time, result in a triggering of the given protective action. On the other hand, a sequence of critical pulsation amplitudes that occur, even though only for relative short periods of time but with comparatively small intervals, also triggers the respective protective action. On the other hand, the trigger counter is set back to zero if, during a time-frame that is defined by the specified count of the reset counter, no critical pulsation amplitudes occur. In this manner, short-term, temporary, and harmless disturbances can be distinguished from serious disturbances of the pulsation behavior. Accordingly, an unnecessary shutdown of the gas turbine can be prevented with this protection process as well. Additionally, it is possible to cover a variety of trigger conditions with this protection process. For example, the time setting and/or trigger level may be selected differently for different operating conditions of the gas turbine, for example, normal operation, startup, shutdown. The proposed combination makes it possible to achieve a particularly effective protection of the gas turbine from damage caused by pressure pulsations.

Additional important characteristics and advantages of the present invention will become apparent from the drawings and from the associated description of the figures based on the drawings.

BRIEF DESCRIPTION OF THE DRAWINGS

Preferred example embodiments of the invention are depicted in the drawings and will be explained in more detail in the following description, with identical reference symbols referring to identical, or similar, or functionally identical components. The drawings are schematic depictions, in each case, as follows.

DETAILED DESCRIPTION OF EXEMPLARY EMBODIMENTS

Figure 1:
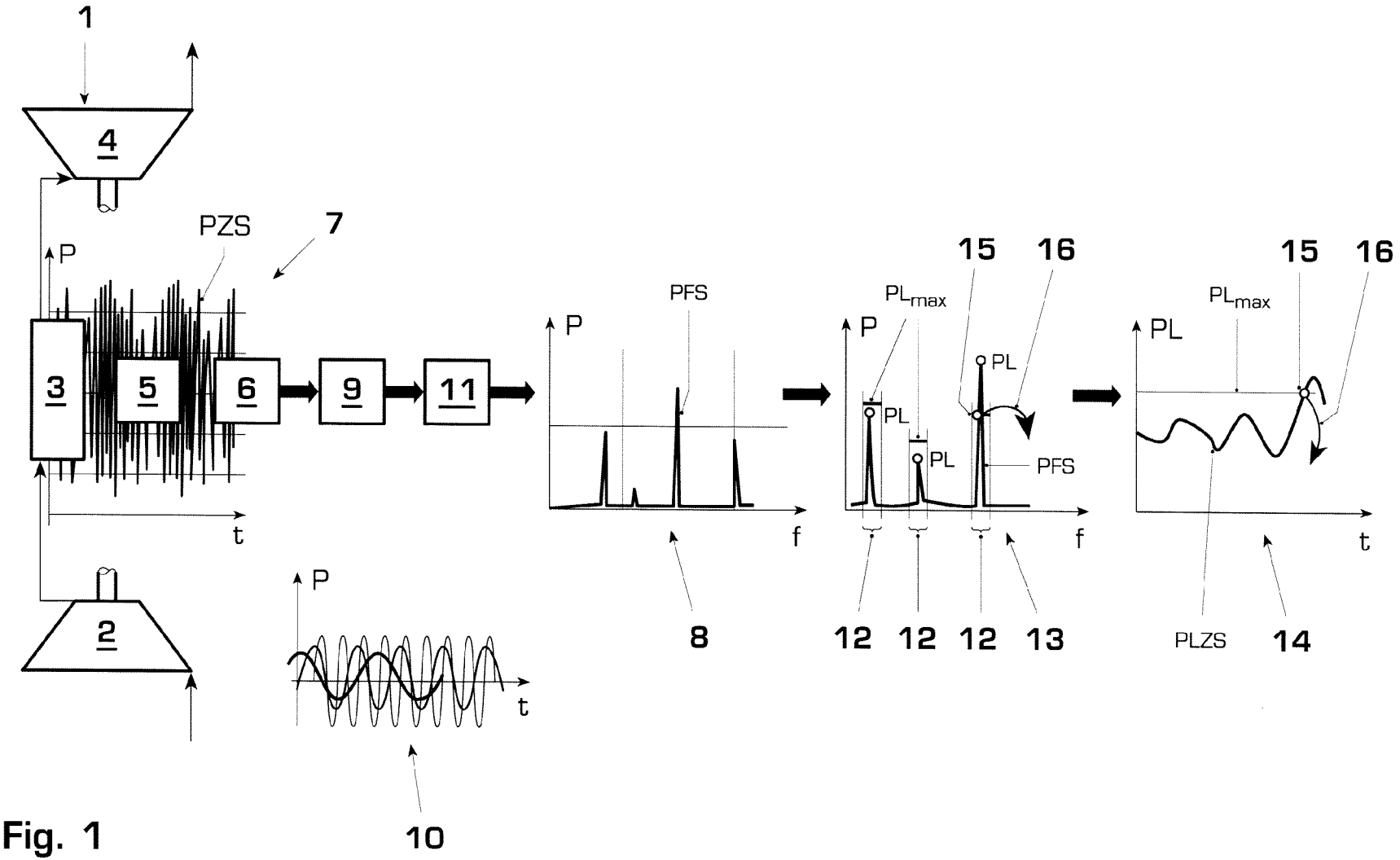
FIG. 1 is a diagram, in the style of a flow chart, of the inventive protection process.

In accordance with FIG. 1, a gas turbine 1 commonly incorporates a condenser 2, a combustion chamber 3, as well as a turbine 4. In the gas turbine 1, especially in its combustion chamber 3, pressure pulsations P can occur during the operation of the gas turbine 1. These pressure pulsations, or pulsations P in short, are measured e.g., in the region of the combustion chamber 3 with the aid of a suitable sensor means 5. The sensor means 5, in this context, may incorporate a microphone, a dynamic pressure intensifier, a piezoelectric pressure gauge, a piezoresistive pressure gauge, or other suitable device for measuring the pressure pulsations. Likewise, the pressure pulsations P can, for example, be determined indirectly via the acceleration of combustion chamber components. The measured pressure pulsations P may, for example, be processed by means of a suitable amplifier 6, in order to generate from them a pulsation-time signal PZS. The pulsation-time signal PZS, in this context, represents the dependence of the pulsation P on the time t. In FIG. 1 this correlation is visualized by a diagram 7, wherein the pulsation P forms the ordinate, whereas the time t forms the abscissa.

In the present invention the pulsation-time signal PZS is now transformed into a pulsation-frequency signal PFS, which includes the dependence of the pulsation P on the frequency f (frequency spectrum). The pulsation-frequency signal PFS that is determined in this manner is visualized in FIG. 1 by a diagram 8, whose ordinate is formed by the pulsation P and whose abscissa is formed by the frequency f. The pulsation-frequency signal PFS can be derived from the pulsation-time signal PZS with the aid of a suitable mathematical, especially numerical method, for example with the aid of a Fourier transformer 9, which performs a corresponding Fourier analysis for this purpose. The Fourier transform is depicted symbolically in FIG. 1 by means of a diagram 10. The Fourier transformer 9 may operate, for example, with a FFT (fast Fourier transform) or DFT (discrete Fourier transform). The Fourier transformer 9 may have a rectifier 11, especially an RMS rectifier connected downstream from it, with RMS standing for Root Mean Square (in this case the effective signal level).

Furthermore, the pulsation-frequency signal PFS can additionally be conditioned. For example, interferences can be suppressed.

Within the pulsation-frequency signal PFS, at least one specified monitoring frequency band 12 is monitored. Preferably, however, a plurality of specified monitoring frequency bands 12 are monitored. The monitoring frequency bands 12 are marked in an additional diagram 13 with braces.

As a rule, it is possible to select the monitoring frequency bands 12 such that a plurality of interfering or critical or dangerous pulsation frequencies to be monitored lie in the respective monitoring frequency band 12. Preferred in this case, however, is an embodiment in which precisely one critical pulsation frequency to be monitored lies in each monitoring frequency band 12.

It is seen as a significant advantage of the present invention that, within the pulsation-frequency signal PFS, the monitoring frequency bands 12 can be selected with comparatively small frequency bandwidths. This makes it possible to clearly separate critical, dangerous pulsation frequencies from uncritical, harmless pulsation frequencies, and thus distinguish between them even if the harmless pulsation frequencies lie relatively close to critical, dangerous pulsation frequencies.

For each specified monitoring frequency band 12 a pulsation level PL is determined. This pulsation level PL correlates with a pulsation amplitude of the monitored pulsation frequency within the respective monitoring frequency band 12.

Determining of the pulsation level PL may take place by various methods. For example, an average of the pulsation amplitudes occurring in the monitoring frequency band 12 may be formed within the respective monitoring frequency band 12. Specifically, effective values or root mean values may again be formed in this case. The averaging process is particularly suitable for determining the pulsation level PL if more than one specified critical pulsation frequency has been assigned to the respective monitoring frequency band 12.

Alternatively, in a preferred embodiment, the pulsation level PL can be determined within the respective monitoring frequency band 12 in such a way that the maximum pulsation value (peak) that occurs in the respective monitoring frequency band 12 is used for the pulsation level PL in each case. This correlation is illustrated in diagram 13. The pulsation maxima are formed in each case by peaks of the pulsation-frequency signal PFS, and define in this manner the given pulsation level PL.

According to the invention the pulsation levels PL are now monitored for the occurrence of at least one specified trigger condition. This monitoring process is depicted in FIG. 1 by way of example in an additional diagram 14, which illustrates the time curve of the pulsation level PL. The pulsation level PL forms the ordinate in diagram 14, whereas the abscissa is formed by the time t. The diagram 14, in this case, shows the time curve of the pulsation level PL, i.e., a pulsation-level time signal PLZS for a single monitoring frequency band 12 and thus specifically for only one critical pulsation frequency to be monitored.

Accordingly, a pulsation-level time signal PLZS is generated in this case, which is then monitored for the at least one trigger condition. In this context it is possible, as a general rule, to process this pulsation-level time signal PLZS in a suitable manner. Especially an averaging process may take place here as well, especially through determination of the effective value.

The pulsation levels PL are advantageously monitored separately from each another for the different monitoring frequency bands 12.

Serving as the trigger condition may be, for example, a maximum pulsation level $PL_{max}$. As soon as the pulsation level PL reaches the maximum pulsation level $PL_{max}$, this trigger condition is present. This is given in diagram 14 by the point of intersection of the pulsation-level time signal PLZS with the maximum value of the pulsation level $PL_{max}$, which is denoted in diagrams 13 and 14 with 15. The point of intersection 15 thus represents the occurrence of said trigger condition, which, in accordance with the invention, triggers a specified protective action, symbolized here in diagrams 13 and 14 by an arrow 16. This protective action 16 may be, for example, a reduction in the fuel supply and/or an enrichment of the fuel/air mixture, or a shutdown of the combustion chamber 3, but it may also be only an alarm issued to the operator. Other protective reactions 16, or a combination of such measures are possible as well.

If—like in this case—the pulsation level PL is formed within the individual monitoring frequency bands 12 by the peak occurring therein, the option presents itself, according to an advantageous embodiment, to not fix the monitoring frequency band 12 statically but to dynamically adapt it to shifts in the maximum pulsation value, i.e., in this case the pulsation level PL. This is done with a corresponding shifting of the respective monitoring frequency band 12 such that the peak of the pulsation-frequency signal PFS remains within the monitoring frequency band 12. A shifting along the abscissa of the critical pulsation frequency to be monitored, i.e., a frequency shift, occurs for example, if the sound velocity changes within the combustion chamber 3, for example through a temperature change. In this manner, it can be prevented that the pulsation frequency to be monitored migrates out of the monitoring frequency band 12, even when only a very narrow frequency bandwidth is selected for the monitoring frequency band 12.

For the processing of the pulsation-frequency signal PFS it is additionally possible to mask harmonics. For example, when a pulsation occurs in a given test band, an examination is first performed for this purpose as to whether it could be a harmonic of a pulsation (fundamental frequency, base) from a low frequency range. If this is the case, all harmonics are erased from the examined portion of the pulsation-frequency signal PFS, i.e., the signal amplitudes over the associated frequencies are set to zero. Pulsation levels are thus only taken into consideration during the monitoring process if the associated pulsation is precisely not a harmonic. The reason being that the base pulsation on which the harmonic is based is already monitored in its own monitoring frequency band.

Figure 2:
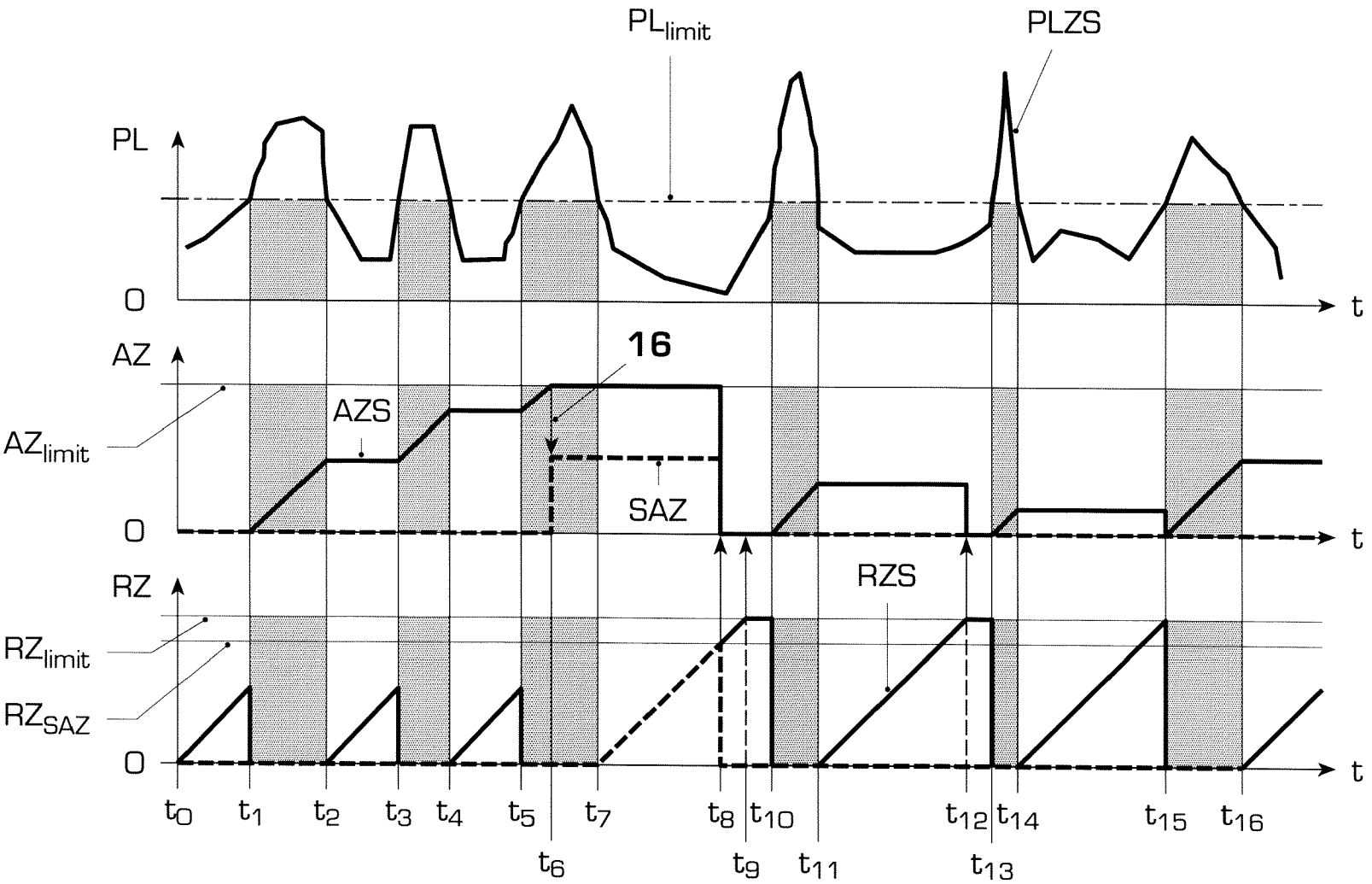
FIG. 2 is a view as in FIG. 1, but for a different component of the process.

In accordance with FIG. 2, monitoring of the pulsation level PL or of the pulsation-level time signal PLZS can take place according to the invention also in such a way that at least one other trigger condition has a special trigger strategy. This trigger strategy operates with a trigger counter AZ and with a reset counter RZ. Grouped together in FIG. 2 are now three diagrams, the top diagram of which reflects the time curve of the pulsation level PL, whereas the middle diagram shows the time curve of the trigger counter AZ, and the bottom diagram depicts the time curve of the reset counter RZ. The top diagram accordingly shows the pulsation-level time signal PLZS, whereas the bottom diagrams reflect a trigger counter signal AZS and reset counter signal RZS, respectively.

Also entered in the top diagram is a level limit value $PL_{limit}$. This level limit value $PL_{limit}$ may be smaller than the pulsation level maximum $PL_{max}$ from diagram 14 according to FIG. 1. While exceeding or reaching the pulsation level maximum $PL_{max}$ immediately triggers the protective action 16, reaching or exceeding the level limit value $PL_{limit}$ in accordance with the trigger strategy described below does not immediately result in a triggering of the protective action 16. In this context it is possible, as a general rule, for both trigger conditions to exist together.

The trigger counter AZ counts the time during which the pulsation level PL lies above the level limit value $PL_{limit}$. In the process the trigger counter AZ always adds this time to a preceding count of the counter. As soon as the trigger counter AZ reaches a specified trigger counter reading $AZ_{limit}$, the trigger condition arises. As a general rule, a trigger flag is set for this purpose and the respective protective action 16 is started.

In contrast to the above, the reset counter RZ counts the time during which the pulsation level PL lies below, or not above the level limit value $PL_{limit}$. In contrast to the trigger counter AZ, the reset counter RZ always adds to a counter reading that has been set to zero. However, as soon as the reset counter RZ reaches a specified count $RZ_{limit}$ of the reset counter, the count of the trigger counter AZ is set to zero.

This trigger strategy will be explained again below, based on the example shown in FIG. 2:

At the point in time $t_0$ the monitoring starts. The pulsation level PL is below the limit level $PL_{limit}$. The reset counter RZ subsequently starts to count from the value zero and adds up the time. At the point in time $t_1$ the pulsation level PL exceeds the level limit value $PL_{limit}$. Next, the trigger counter AZ starts to count the time. Since, at the beginning, the trigger counter reading in the example has the value zero, the trigger counter at the point in time $t_1$ starts to add from zero. At the point in time $t_2$ the pulsation level PL again drops below the level limit value $PL_{limit}$. The trigger counter AZ subsequently does not continue to count, while the reset counter RZ again begins its time count from zero. At the point in time $t_3$ the pulsation level PL again exceeds the level limit value $PL_{limit}$; the trigger counter AZ continues to count, adding to the preceding counter reading. At the point in time $t_4$ the pulsation level PL again drops below the level limit value $PL_{limit}$, so that the trigger counter AZ does not continue to count and the reset counter RZ again starts its time count from zero.

At the point in time $t_5$ the pulsation level PL again exceeds the level limit value $PL_{limit}$, so that the trigger counter AZ again adds to the preceding counter reading. At the point in time $t_6$ the counter reading of the trigger counter AZ reaches the trigger counter reading $AZ_{limit}$. Consequently the trigger condition is present and the protective action 16 is started. For example, an alarm is issued, or the fuel supply to the combustion chamber 3 is changed for the duration of the protective action 16. In the middle diagram the status of the protective reaction 16 is entered in addition, in this case with a simplified differentiation between only an Off condition and an On condition. The course of the protective action status is marked in FIG. 2 with SAZ. At the point in time $t_6$ a switching thus occurs from the Off condition to the On condition.

Because of the protective action 16, the pulsation level PL drops once again and at the time $t_7$ is below the level limit value $PL_{limit}$. The reset counter RZ subsequently again starts to add the time from zero. At the point in time $t_8$ the reset counter RZ reaches a counter reading denoted with $RZ_{SAZ}$. At this counter reading $RZ_{SAZ}$ the protective action status is changed, on one hand, i.e., a switching occurs from the On condition to the Off condition. On the other hand, the trigger counter AZ is simultaneously reset to zero.

Even though, at the point in time $t_9$ the reset counter RZ reaches the reset counter reading $RZ_{limit}$, which normally resets the counter reading of the trigger counter AZ to zero, this, however, has already occurred in the present case because a protective action 16 was previously triggered and terminated. Accordingly, the associated counter reading $RZ_{SAZ}$ is selected smaller in this case than the reset counter reading $RZ_{limit}$.

At the point in time $t_{10}$ the pulsation level PL again exceeds the level limit value $PL_{limit}$, so that the trigger counter AZ again begins to count the time. In the process, the trigger counter AZ starts from the value zero this time, due to the previously occurred resetting.

At the point in time $t_{11}$ the pulsation level PL again drops below the level limit value $PL_{limit}$. The trigger counter AZ therefore does not continue to count, whereas the reset counter RZ again starts to count from zero. At the point in time $t_{12}$ the reset counter RZ reaches its reset counter reading $RZ_{limit}$, triggering a resetting of the counter reading of the trigger counter AZ to the value zero. At the point in time $t_{13}$, the trigger counter AZ thus starts again at zero as the pulsation level PL exceeds the level limit value $PL_{limit}$. At the point in time $t_{14}$ the pulsation level PL again drops below the level limit value $PL_{limit}$. While the counter reading of the trigger counter AZ is maintained, the reset counter RZ again starts to count from zero. At the point in time $t_{15}$ the reset counter RZ reaches its reset counter reading $RZ_{limit}$, resulting in a resetting of the trigger counter AZ. At the same time the pulsation level PL at this point in time $t_{15}$ again reaches its level limit value $PL_{limit}$, which immediately triggers a counting by the trigger counter AZ. At the point in time $t_{16}$ the pulsation level PL again drops below the level limit value $PL_{limit}$. The added-up counter reading of the trigger counter AZ is maintained, while the reset counter RZ again starts to count the time starting from zero.

Figure 3:
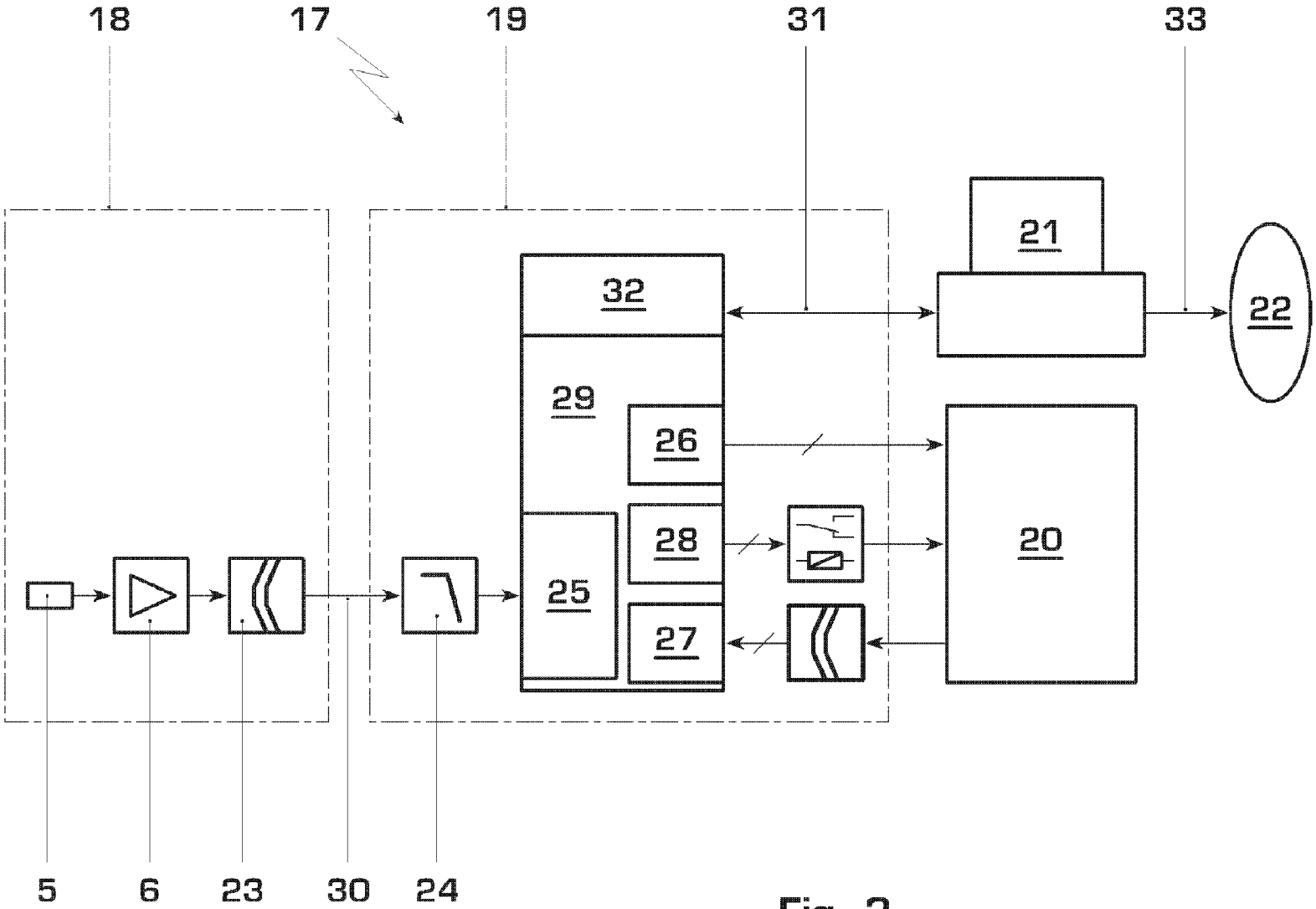
FIG. 3 is a circuit-diagram-like schematic depiction of a control system according to the invention.

In accordance with FIG. 3, a control system 17 of the gas turbine 1 may have a pulsation measuring device 18, a pulsation evaluation device 19, as well as a control device 20. A monitoring device 21, as well as optionally a display and/or diagnosis system 22 may additionally be provided as well.

The pulsation measuring device 18 incorporates a sensor means 5 and the signal amplifier 6, and it may additionally incorporate a galvanic isolation means 23. The pulsation measuring device 18 thus serves to measure the pressure pulsations P at the gas turbine 1, especially in its combustion chamber 3. The pulsation measuring device 18 additionally generates the pulsation-time signal PZS.

The pulsation evaluation device 19 incorporates, for example, a lowpass filter 24, an analog input 25, an analog output 26, as well as a digital input 27 and a digital output 28. The inputs and outputs 25 through 28 are incorporated into a computer 29 in this case that permits a real-time processing of the pulsation-time signal PZS. The pulsation evaluation device 19 can thus transform the pulsation-time signal PZS into the pulsation-frequency signal PFS, determine from the pulsation-frequency signal PFS for at least one specified monitoring frequency band 12 the pulsation level PL, monitor this pulsation level PL for the occurrence of at least one specified trigger condition, and when this at least one trigger condition occurs, generate a trigger signal. The transmission of the pulsation-time signal PZS between the pulsation measuring device 18 and pulsation evaluation unit 19 may take place in this case by means of a galvanically decoupled connection 30, i.e., without direct electrical contact. The signal transfer may take place by optical means, for example, or by means of a transformer. The galvanic decoupling is attained in this case by the galvanic isolation means 23.

On one hand, the control device 20 controls the normal operation of the gas turbine 1 and, due to its integration into the control system 17, permits specified protective actions to be performed if the respective trigger signal is present. This trigger signal is obtained by the control device 20 from the pulsation evaluation device 19, especially from its computer 29. However, the control device 20 may also receive the pulsation levels PL of the monitoring bands via the analog output 26 and perform the evaluation of the trigger signal according to FIG. 2 by itself.

The monitoring device 21 may communicate via a network connection 31 and via a network controller 32 with the computer 29 of the pulsation evaluation device 19. The monitoring device 21 may, for example, configure, visualize and/or store the pulsation monitoring process that is performed with the aid of the pulsation evaluation device 19. Additionally, the monitoring device 21 is coupled, in this case, with the display system and/or diagnosis system 22, for example via the Internet 33, permitting, for example, an evaluation of the long-term operation of the gas turbine 1. Specifically, this evaluation may take place centrally for a plurality of different gas turbines 1 that may be distributed globally.

LIST OF REFERENCE SYMBOLS

1 gas turbine
2 condenser
3 combustion chamber
4 turbine
5 sensor means
6 amplifier
7 diagram
8 diagram
9 Fourier transformer
10 diagram
11 RMS rectifier
12 monitoring frequency band
13 diagram
14 diagram
15 point of intersection
16 protective action
17 control system
18 pulsation measuring device
19 pulsation evaluation device
20 control device
21 monitoring device
22 display system and/or diagnosis system
23 galvanic separator
24 lowpass filter
25 analog input
26 analog output
27 digital input
28 digital output
29 computer
30 galvanically decoupled connection
31 network connection
32 network controller
33 Internet
P pulsation
Z time
PZS pulsation-time signal
F frequency
PFS pulsation-frequency signal
PL pulsation level
$PL_{max}$ maximum pulsation value
PLZS pulsation-level time signal
$PL_{limit}$ level limit value
AZ trigger counter
$AZ_{limit}$ trigger counter reading
AZS trigger-counter time signal
RZ reset counter
$RZ_{limit}$ reset counter reading
RZS reset-counter time signal
SAZ protective-action condition
$RZ_{SAZ}$ certain counter reading of the reset counter
$t_0$-$t_{16}$ certain points in time While the invention has been described in detail with reference to exemplary embodiments thereof, it will be apparent to one skilled in the art that various changes can be made, and equivalents employed, without departing from the scope of the invention.

What is claimed is:

1. A process for protection of a gas turbine from damage caused by pressure pulsations, the process comprising:

measuring pressure pulsations occurring during the operation of the gas turbine;

generating a pulsation-time signal from the measured pressure pulsations;

transforming the pulsation-time signal into a pulsation-frequency signal;

determining from the pulsation-frequency signal a pulsation level for at least one specified monitoring frequency band, wherein determining the pulsation level comprises determining from the maximum pulsation value in the monitoring frequency band;

monitoring the pulsation level for the occurrence of at least one trigger condition;

carrying out, when the at least one trigger condition occurs, a protective action; and shifting the monitoring frequency band upon a frequency shift of the maximum pulsation value, to follow the maximum pulsation value, so that the maximum pulsation value remains within the monitoring frequency band.

2. A process according to claim 1, wherein determining the pulsation level comprises summation, integration, averaging, or combinations thereof, of the pulsation values in the monitoring frequency band.

3. A process according to claim 1, wherein the monitoring frequency band is defined such that when precisely one previously known critical pulsation again occurs, the monitoring frequency band lies with its pulsation frequency in said monitoring frequency band.

4. A process according to claim 1, further comprising:

generating, from the pulsation level, a pulsation-level time signal; and monitoring the pulsation-level time signal for the at least one trigger condition.

5. A process according to claim 4, further comprising:

averaging the pulsation-level time signal.

6. A process according to claim 1, wherein generating the pulsation-frequency signal from the pulsation-time signal comprises generating with a numerical-mathematical transformation.

7. A process according to claim 6, wherein the numerical-mathematical transformation comprises a fast Fourier transform or a discrete Fourier transform.

8. A process according to claim 1, wherein said monitoring the pulsation level for the occurrence of at least one specified trigger condition comprises monitoring separately for each monitoring frequency band.

9. A process for protection of a gas turbine from damage caused by pressure pulsations, the process comprising:

measuring pressure pulsations occurring during the operation of the gas turbine;

generating a pulsation-time signal from the measured pressure pulsations;

transforming the pulsation-time signal into a pulsation-frequency signal;

determining from the pulsation-frequency signal a pulsation level for at least one specified monitoring frequency band;

monitoring the pulsation level for the occurrence of at least one trigger condition; and, carrying out, when the at least one trigger condition occurs, a protective action examining, when a pulsation occurs, whether said pulsation is a harmonic of a pulsation from a lower frequency range; and monitoring an associated pulsation level only if the associated pulsation is not a harmonic.

10. A process for protection of a gas turbine from damage caused by pressure pulsations, the process comprising:

measuring pressure pulsations occurring during the operation of the gas turbine;

generating a pulsation-time signal from the measured pressure pulsations;

transforming the pulsation-time signal into a pulsation-frequency signal;

determining from the pulsation-frequency signal a pulsation level for at least one specified monitoring frequency band;

monitoring the pulsation level for the occurrence of at least one trigger condition;

carrying out, when the at least one trigger condition occurs, a protective action;

wherein the at least one trigger condition comprises a trigger strategy including a trigger counter (AZ) and a reset counter (RZ);

wherein the trigger counter (AZ) comprises adding the time (t) during which the pulsation level lies above a specified level limit value ($PL_{limit}$) to the preceding counter reading;

wherein the at least one trigger condition occurs and the specified protective action is started as soon as the trigger counter (AZ) reaches a specified trigger counter reading ($AZ_{limit}$);

wherein the reset counter (RZ) comprises adding the time (t) during which the pulsation level (PL) does not lie above the level limit value ($PL_{limit}$) to a counter reading that has been reset to zero; and further comprising setting to zero the counter reading of the trigger counter (AZ) as soon as the reset counter (RZ) reaches a specified reset counter reading ($RZ_{limit}$).

11. A process according to claim 10, further comprising:

terminating the protective action and setting to zero the counter reading of the trigger counter (AZ) if the reset counter (RZ) reaches a specified counter reading ($RZ_{SAZ}$) during the protective action.

12. A process according to claim 11, wherein said specified counter reading ($RZ_{SAZ}$) is smaller than the reset counter reading ($RZ_{limit}$).

13. A control system for a gas turbine comprising:

a pulsation measuring device which includes and is configured and arranged to measure with a sensor the pressure pulsations occurring during the operation of the gas turbine and generates a pulsation-time signal (PZS) correlated with said pressure pulsations;

a pulsation evaluation device configured and arranged to transform the pulsation-time signal (PZS) into a pulsation-frequency signal (PFS), determine from the pulsation-frequency signal (PFS) for at least one specified monitoring frequency band a pulsation level (PL), monitor the pulsation-frequency signal for the occurrence of at least one specified trigger condition, and when the at least one trigger condition occurs, generate a trigger signal;

a control device configured and arranged to perform a specified protective action when the trigger signal is present; and a galvanically decoupled connection configured and arranged to transmit the pulsation-time signal (PZS) between the pulsation measuring device and pulsation evaluation device.

14. A control system according to claim 13, further comprising:

a monitoring device in communication with the pulsation evaluation device and configured and arranged to permit configuring of the pulsation evaluation device, visualization of said pulsation monitoring, storing the pulsation monitoring process, or combinations thereof.

15. A control system according to claim 14, further comprising:

a display system, a diagnosis system or both;

wherein the monitoring device is connected to the display system, to the diagnosis system, or to both.

* * * * *